US009352181B2

(12) United States Patent
O'Neil

(10) Patent No.: US 9,352,181 B2
(45) Date of Patent: May 31, 2016

(54) FULL BODY EXERCISE MACHINE

(71) Applicant: Randall O'Neil, Battle Creek, MI (US)

(72) Inventor: Randall O'Neil, Battle Creek, MI (US)

( * ) Notice: Subject to any disclaimer, the term of this patent is extended or adjusted under 35 U.S.C. 154(b) by 64 days.

(21) Appl. No.: 14/150,104

(22) Filed: Jan. 8, 2014

(65) Prior Publication Data

US 2014/0194261 A1 Jul. 10, 2014

Related U.S. Application Data

(60) Provisional application No. 61/749,974, filed on Jan. 8, 2013.

(51) Int. Cl.

| | |
|---|---|
| ***A63B 71/00*** | (2006.01) |
| ***A63B 21/00*** | (2006.01) |
| ***A63B 21/018*** | (2006.01) |
| ***A63B 23/12*** | (2006.01) |
| *A63B 23/035* | (2006.01) |
| *A63B 71/02* | (2006.01) |

(52) U.S. Cl.

CPC ..... *A63B 21/00069* (2013.01); *A63B 21/018* (2013.01); *A63B 21/4035* (2015.10); *A63B 21/4043* (2015.10); *A63B 23/03541* (2013.01); *A63B 23/12* (2013.01); *A63B 23/0355* (2013.01); *A63B 23/03575* (2013.01); *A63B 2071/027* (2013.01); *A63B 2220/17* (2013.01); *A63B 2230/06* (2013.01); *A63B 2230/75* (2013.01)

(58) Field of Classification Search

CPC ..... A63B 21/00069; A63B 21/018; A63B 21/1484; A63B 21/1469; A63B 23/12; A63B 23/1209; A63B 23/03575; A63B 23/0355; A63B 2071/027; A63B 21/04; A63B 21/4001; A63B 21/4003; A63B 21/4005; A63B 21/4007; A63B 21/4009; A63B 21/4011; A63B 21/4013; A63B 21/4015; A63B 21/4017; A63B 21/4019; A63B 21/4021; A63B 21/4023; A63B 21/4025; A63B 21/4027; A63B 21/4029; A63B 21/4031; A63B 21/4033; A63B 21/403

See application file for complete search history.

(56) References Cited

U.S. PATENT DOCUMENTS

| | | | | | |
|---|---|---|---|---|---|
| 3,472,510 | A * | 10/1969 | Holkesvick | A63B 21/018 | 482/120 |
| 3,510,132 | A * | 5/1970 | Holkesvick | A63B 21/018 | 482/120 |
| 5,090,694 | A * | 2/1992 | Pauls | A63B 21/015 | 482/118 |
| 5,674,167 | A * | 10/1997 | Piaget | A63B 21/0552 | 482/130 |
| 7,291,099 | B1 * | 11/2007 | Marczewski | | 482/114 |
| 7,410,450 | B1 * | 8/2008 | Paulding | A63B 21/0552 | 482/120 |
| 9,067,100 | B2 * | 6/2015 | Habing | A63B 21/156 | |
| 2003/0115955 | A1 * | 6/2003 | Keiser | A63B 21/0087 | 73/379.06 |
| 2003/0176261 | A1 * | 9/2003 | Simonson | A63B 21/062 | 482/103 |

(Continued)

*Primary Examiner* — Loan H Thanh
*Assistant Examiner* — Megan Anderson
(74) *Attorney, Agent, or Firm* — Varnum, Riddering, Schmidt & Howlett LLP

(57) ABSTRACT

A full body exercise apparatus and method allowing for a full body workout utilizing all major muscle groups. The apparatus generally consists of a plurality of ropes allowing the user to pull the handles providing for arm resistance as well as leg and core resistance in a downward and upward motion by the user. The result is a full body workout after a series of repetitions using the apparatus.

14 Claims, 2 Drawing Sheets

(56) References Cited

U.S. PATENT DOCUMENTS

2003/0232706 A1* 12/2003 Emick ..... A63B 21/04 482/123
2004/0198571 A1* 10/2004 Howell ..... A63B 21/026 482/123
2007/0087920 A1* 4/2007 Dachraoui ..... A63B 21/0552 482/123
2010/0041520 A1* 2/2010 Popescu ..... A63B 21/015 482/37
2011/0195825 A1* 8/2011 Liester ..... 482/120
2012/0202656 A1* 8/2012 Dorsay ..... A63B 23/1209 482/121
2012/0225760 A1* 9/2012 Webb ..... A63B 21/062 482/139
2013/0130866 A1* 5/2013 Wehrell ..... 482/5
2013/0274075 A1* 10/2013 Habing ..... A63B 21/062 482/102
2013/0303346 A1* 11/2013 Barker ..... 482/129
2015/0038300 A1* 2/2015 Forhan ..... A63B 21/00047 482/72

* cited by examiner

FULL BODY EXERCISE MACHINE

CROSS-REFERENCE TO RELATED APPLICATION

This application claims priority of U.S. Provisional Patent Application Ser. No. 61/749,974 filed Jan. 8, 2013, entitled "Fully Body Exercise Machine", which is incorporated herein in its entirety by reference.

FIELD OF THE INVENTION

The present invention relates generally to exercise equipment. More particularly, the invention relates to exercise equipment having ropes affording for a full body workout.

BACKGROUND OF THE INVENTION

Full body exercise equipment is known in the art. However, this equipment is expensive and frequently ineffective. It is a common need for people recovering from injuries or illnesses to desire an apparatus which provides for a full body workout. Others generally wanting to keep in shape also benefit from such a full body workout. However, there lacks an apparatus providing a full body workout which is affordable and equally effective working the full range of muscles in the human body.

There are few devices or apparatuses which exercise all the major muscle groups while providing for simultaneous range of motion and extension. One of these machines is the ROM machine utilizing a heavy-weight fly wheel to create full body resistance. Further, the well known Nordic Track utilizes full body motion by using friction to restrict the motion of their ski machines. There is no known full body exercise device utilizing a constant pulling to work a full range of muscles. As such, there exists a need in the art to provide an affordable full body exercise machine allowing the user to have a full range of motion in exercising all major muscle groups.

SUMMARY OF THE INVENTION

The present invention provides for a full body exercise apparatus allowing for a full body workout utilizing all major muscle groups. The apparatus generally consists of a plurality of ropes allowing the user to pull the handles providing for arm resistance as well as leg and core resistance in a downward and upward motion by the user. The result is a full body workout after a series of repetitions using the apparatus.

An exercise apparatus for utilizing all major muscle groups to be positioned on a floor, the apparatus comprising a planar base, the base positioned parallel with the floor. The apparatus including at least one elongated arm connected to the base, the at least one elongated arm extending upwardly away from the base, at least one handle connected to the at least one elongated arm, the at least one handle connected to the at least one elongated arm by means of a rope, the rope wrapped around the at least one elongated arm. The at least one handle operable to move from a first position to a second position by sliding the rope along the at least one elongated arm thereby providing resistance to a user.

A method of the present invention is also provided. A method of exercising using an exercise apparatus, the method comprising the steps of stepping on a base of the exercise apparatus and gripping at least one handle, the at least one handle connected to at least one elongated arm, the at least one handle connected to the at least one elongated arm by means of a rope. The method further comprising the step of moving from a first position to a second position, the first position defined where the user is in a full squat position with the arms extending laterally forward, the second position defined where there user is in a full, standing position with the arms extended overhead. Repeating the process of moving from the first position to the second position until a completion of the workout. The method further includes the step of increasing the resistance of the apparatus by wrapping the rope around the elongated arms multiple times or decreasing the resistance of the apparatus by decreasing the amount the rope is wrapped around the at elongated arms.

DETAILED DESCRIPTION OF THE INVENTION

The present invention provides for an apparatus allowing for a full body workout utilizing all major muscle groups. The apparatus generally consists of a plurality of ropes allowing the user to pull the handles providing for arm resistance as well as leg and core resistance in a downward and upward motion by the user. The result is a full body workout after a series of repetitions using the apparatus.

An exercise apparatus for utilizing all major muscle groups to be positioned on a floor, the apparatus comprising a planar base, the base positioned parallel with the floor. The apparatus including at least one elongated arm connected to the base, the at least one elongated arm extending upwardly away from the base, at least one handle connected to the at least one elongated arm, the at least one handle connected to the at least one elongated arm by means of a rope, the rope wrapped around the at least one elongated arm. The at least one handle operable to move from a first position to a second position by sliding the rope along the at least one elongated arm thereby providing resistance to a user. The exercise apparatus where the at least one elongated arm includes a free end. The exercise apparatus where the free end of the elongated arm includes a hook to hold the rope. The exercise apparatus where the rope is wrapped multiple times around the elongated arm thereby increasing resistance. The exercise apparatus where the base is connected to a frame. The exercise apparatus where the at least one elongated arm is connected to the frame where the frame holds the base. The exercise apparatus where the rope connects to the frame. The exercise apparatus where the at least one elongated arm is collapsible.

Figure 1:
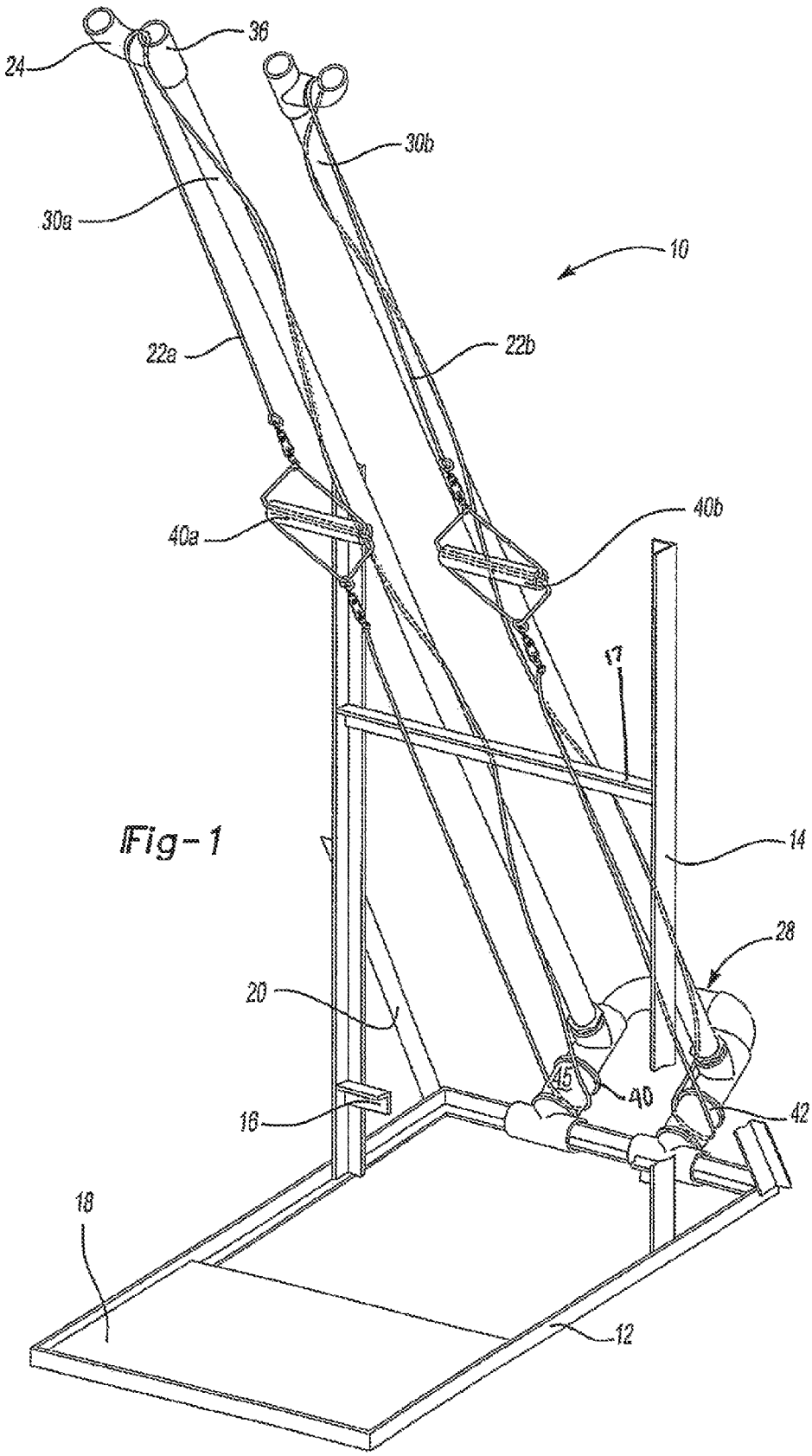
FIG. 1 is a perspective view of the apparatus of the present invention.

FIG. 1 illustrates the apparatus 10 including a base 12 and support 14. The support 14 further includes cross supports 16. The base 12 includes a platform 18 allowing the user of the apparatus 10 to stand on the platform 18. In the present embodiment, the platform 18 is made of a wood material. Alternatively, the platform may be a metal, plastic, polymer or polymer like material. A connection point 20 is provided connected to the base 12 connecting the arms 30*a*, 30*b*. FIG. 1 further illustrates the apparatus 10 further includes a support bar 17. The support bar 17 extends between arms of the support 14. The arms 30*a*, 30*b* extend at an angle generally upwards and rest on the support bar 17. The support bar 17 may be adjusted to raise or lower the arms to accommodate the height of the user or to change resistance.

The arms 30*a*, 30*b* connect to the base 12 by means of the connection point and connection apparatus 28. In the present embodiment, the arms 30*a*, 30*b* are made of a polymer PVC piping and are generally tubular and flexible. In alternative embodiments, the arms 30*a*, 30*b* may be made of metal, plastic or other polymers. The arms 30*a*, 30*b* are flexible allowing the arms 30*a*, 30*b* to bend towards the user.

Figure 2:
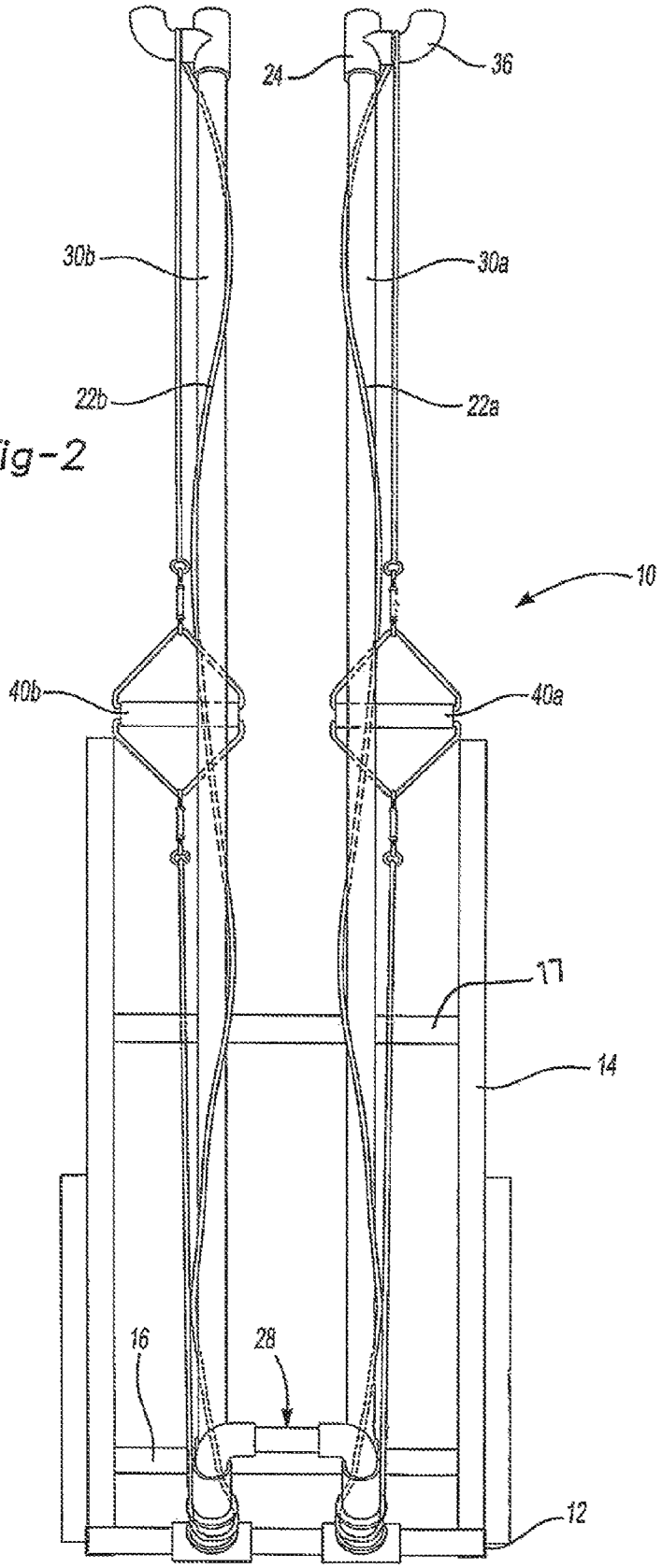
FIG. 2 is a rear view of the apparatus of the present invention.

FIG. 2 illustrates a close-up view of the connection point 28. The arms 30*a*, 30*b* extend away from the connection point 28 at a generally angled position. In the present embodiment, the arms in connection point 28 are made of a polymer or plastic-like material. In other embodiments, the connection point 28 materials may be made out of a metal, plastic-like or polymer-like material. The arms 30*a*, 30*b* vary in length but are generally between 4 feet and 10 feet in length. The connection point 28 includes connection portions 40, 42 which are designed to allow the arms 30*a*, 30*b* to be adjusted for both width and height.

The apparatus 10 further includes rope 22*a*, 22*b*. The cord or rope 22*a*, 22*b* is provided connected to the connection point 28, specifically at connection 42, and further connected to an upper portion 24 of the arms 30*a*, 30*b*. The upper portion 24 further includes a hook 36 to accommodate the rope 22*a*, 22*b*. Each portion of rope 22*a*, 22*b* is wrapped around an outer surface of the arms 30*a*, 30*b*. The wrapped rope 22*a*, 22*b* provides further resistance to the user. Wrapping the rope multiple times increases resistance to the user. Each portion of rope 22*a*, 22*b* is connected together by means of a handle 40*a*, 40*b*. The user of the apparatus 10 grasps the handles 40*a*, 40*b*, stands on the platform 18 and raises the awls in a forward lateral position to a high and wide fully-extended point where the arms are extended overhead and further lowers the arms and bends the legs to a squatting position while moving position of the arms and continuously grasping the handles 40*a*, 40*b* to a lower squatted position with the arms of the user fully extended forward. The user then raises back up to a standing position having the arms in an extended lateral position. The sliding motion of the rope around the arms 30*a*, 30*b* provides resistance to the user. Resistance is provided in both the upward and downward movement of the handles. While moving the handles, the body of the user bends forward and fully extends backwards.

The legs go from a full squat position to a fully extended position. The arms move from fully extended forward and down to completely folded in, to fully extended back and up. The process is repeated and reversed to engage all major muscle groups to their full range of motion. The apparatus 10 works the calves, quadriceps, hamstrings, gluteus, abdominals, pectorals, latissimus dorsi, deltoids, trapezius, biceps, and triceps. The apparatus 10 works these muscles simultaneously through their full range of motion. The arms 30*a*, 30*b* and the cords or rope 22*a*, 22*b* create approximately 4 pounds of resistance on each handle 40*a*, 40*b* when moved in both directions. The resistance provided by the rope 20*a*, 20*b* around the arms 30*a*, 30*b* may be adjusted by a plurality of means. By way of example, the rope 20*a*, 20*b* may be adjusted by a turnbuckle, by pinching a portion of the rope 20*a*, 20*b* to the arms 30*a*, 30*b* or other suitable means. A plurality of ropes could be provided to increase resistance. Further, ropes with various coatings or properties may be utilized to increase or decrease resistance. Resistance may also be increased or decreased by manually altering the number of times the rope is wrapped around the arms 30*a*, 30. It is appreciated that the resistance may be altered by a variety of means.

An upper end 24 is provided on the arm 30*b*. The arm 30*b* includes the upper portion 24 including the hook 36. The hook 36 is operable to secure a portion of the rope 22*b*. As the user slides the handles up and down, the rope 22*b* slides over an upper portion of the hook 36. In the present embodiment the hook 36 is generally L shaped having a 90 degree angle. The hook 36 may be a loop or other arrangement operable to secure the rope 22*b*. A corresponding hook 36 is also provided on the arm 30*a*.

The connection portion 28 as shown illustrating the connection point 42. The connection point 42 allows for an area for the rope 22*a*, 22*b* to rest and slide along. The connection portion 42 includes an outer surface 45 allowing the rope 22*a*, 22*b* to slide easily along providing resistance. A corresponding connection portion is also provided on an opposite but symmetrical side of the connection portion 28.

In the present embodiment, the rope 22*a*, 22*b* is made of a generally nylon rope. In other embodiments, the rope 22*a*, 22*b* may be made of a cotton, polyester, or other fibrous material. The base 12, structural elements 16, 18, and the arms 30*a*, 30*b* may be comprised of various materials and have various arrangements depending on the requirements of the user or availability of materials.

In alternative embodiments, the apparatus 10 may be collapsible or foldable allowing for easy storage. By way of example, the arms 30*a*, 30*b* may be foldable onto the base 12 of the apparatus 10. The apparatus 10 may also be provided on wheels allowing for easy transportation within a room. Various other angles of the arms 30*a*, 30*b* may also be experimented with and utilized to provide varying degrees of resistance to the user. Further, alternative embodiments of the apparatus include a time piece allowing the user to track the time elapsed using the apparatus 10. The apparatus 10 may also include a sound machine or speaker operable to provide sound to the user having a particular cadence for which the user can hear and follow. The apparatus 10 may also include a means to count or track the number of repetitions performed on the machine and display that number to the user. The apparatus 10 may also include audio equipment, heart rate monitors, calorie trackers or other statistic monitoring equipment providing a benefit to the user.

The invention is not restricted to the illustrative examples and embodiments described above. The embodiments are not intended as limitations on the scope of the invention. Methods, apparatus, compositions, and the like described herein are exemplary and not intended as limitations on the scope of the invention. Changes therein and other uses will occur to those skilled in the art.

The invention claimed is:

1. An exercise apparatus for utilizing all major muscle groups to be positioned on a floor, the apparatus comprising:

a base connected to a frame, the base positioned parallel with the floor, the base extending between elongated portions of the frame, the base having a platform configured to allow a user to stand thereon;

at least one elongated arm connected to the base, the at least one elongated arm extending upwardly away from the base, the at least one elongated arm having a distal end end adapted to hold a rope, wherein the rope is wrapped multiple times around the at least one elongated arm thereby increasing resistance;

at least one handle connected to the at least one elongated arm, the at least one handle connected to the at least one elongated arm by means of the rope, the rope wrapped around an external surface of the at least one elongated arm, the rope being fully external to the at least one elongated arm; and the rope having a first end and a second end, the at least one handle connected to both the first end and the second end thereby forming a continuous loop with the rope;

the at least one handle operable to move from a first position to a second position by sliding the rope along the at least one elongated arm thereby providing resistance to a user.

2. The exercise apparatus of claim 1 wherein the at least one elongated arm is connected to the frame where the frame holds the base.

3. The exercise apparatus of claim 2 wherein the rope connects to the frame.

4. The exercise apparatus of claim 1 wherein the distal end of the at least one elongated arm includes a hook to hold the rope.

5. The exercise apparatus of claim 1 where the at least one elongated arm is collapsible.

6. A method of exercising using the exercise apparatus of claim 1, the method comprising the steps of:

stepping on the base of the exercise apparatus;

gripping the at least one handle, the at least one handle connected to the at least one elongated arm, the at least one handle connected to the at least one elongated arm by means of the rope;

moving from a first position to a second position, the first position defined where the user is in a full squat position with the arms extending laterally forward, the second position defined where there user is in a full standing position with the arms extended overhead; and repeating the process of moving from the first position to the second position until a completion of the workout.

7. The method of exercising in accordance with claim 6 wherein the method further includes the step of increasing the resistance of the apparatus by wrapping the rope around the at least one elongated arm multiple times.

8. The method of exercising in accordance with claim 6 wherein the method further includes the step of decreasing the resistance of the apparatus by decreasing the amount the rope is wrapped around the at elongated arms.

9. An exercise apparatus for utilizing all major muscle groups to be positioned on a floor, the apparatus comprising:

a base connected to a frame, the base positioned parallel with the floor, the base extending between elongated portions of the frame, the base having a platform configured to allow a user to stand thereon;

at least one elongated arm connected to the base, the at least one elongated arm extending upwardly away from the base, wherein the at least one elongated arm includes a distal end, and wherein the distal end of the at least one elongated arm includes a hook to hold the rope;

a platform connected to the base, the platform spaced apart from the at least one elongated arm;

at least one handle connected to the at least one elongated arm, the at least one handle connected to the at least one elongated arm by means of a rope, the rope wrapped around an external surface of the at least one elongated arm, the rope being fully external to the at least one elongated arm, the rope wrapped around at least a majority of the entire length of the at least one elongated arm; and the at least one handle operable to move from a first position to a second position by sliding the rope along the at least one elongated arm thereby providing resistance to a user.

10. The exercise apparatus of claim 9 wherein the at least one elongated arm is connected to the frame where the frame holds the base.

11. The exercise apparatus of claim 10 wherein the rope connects to the frame.

12. The exercise apparatus of claim 9 wherein the rope is wrapped multiple times around the at least one elongated arm thereby increasing resistance.

13. The exercise apparatus of claim 9 where the at least one elongated arm is collapsible.

14. An exercise apparatus for utilizing all major muscle groups to be positioned on a floor, the apparatus comprising:

a base connected to a frame, the base positioned parallel with the floor, the base extending between elongated portions of the frame, the base having a platform configured to allow a user to stand thereon;

a pair of elongated arms connected to the base through a U-shaped member, the elongated arms spaced apart from one another, the elongated arms extending upwardly away from the base, the elongated arms each having a distal end adapted to hold a respective rope, such that there are a total of two ropes;

a pair of handles, one of each of the pair of handles connected to one of each of the elongated arms, the handles connected to the elongated arms by means of the ropes, the ropes wrapped around the elongated arms, the ropes being fully external to the pair of elongated arms, the ropes wrapped around a portion of the U-shaped member the handles operable to move from a first position to a second position by sliding the rope along the respective pair of elongated arms.

* * * * *